US009526288B2

(12) United States Patent
Pfanner et al.

(10) Patent No.: US 9,526,288 B2
(45) **Date of Patent: *Dec. 27, 2016**

(54) INTERIOR FITTING FOR A PROTECTIVE HELMET, IN PARTICULAR FOR FORESTRY WORKERS

(75) Inventors: Anton Pfanner, Hohenems (AT); Martin Greber, Götzis (AT)

(73) Assignee: PFANNER SCHUTZBEKLEIDUNG GMBH, Hohenems (AT)

( * ) Notice: Subject to any disclaimer, the term of this patent is extended or adjusted under 35 U.S.C. 154(b) by 833 days.

This patent is subject to a terminal disclaimer.

(21) Appl. No.: 13/808,885

(22) PCT Filed: Jul. 12, 2011

(86) PCT No.: PCT/EP2011/061880

§ 371 (c)(1),
(2), (4) Date: Feb. 21, 2013

(87) PCT Pub. No.: WO2012/007473

PCT Pub. Date: Jan. 19, 2012

(65) Prior Publication Data

US 2013/0191973 A1 Aug. 1, 2013

(30) Foreign Application Priority Data

Jul. 13, 2010 (DE) ..... 10 2010 027 014

(51) Int. Cl.

| | |
|---|---|
| ***A42B 3/04*** | (2006.01) |
| ***A42B 3/08*** | (2006.01) |
| ***A42B 3/14*** | (2006.01) |

(52) U.S. Cl.

CPC ..... *A42B 3/0406* (2013.01); *A42B 3/08* (2013.01); *A42B 3/145* (2013.01); *A42B 3/147* (2013.01)

(58) Field of Classification Search

CPC ..... A42B 3/14; A42B 3/04; A42B 3/10; A42B 3/085; A42B 3/142; A42B 3/145; A42B 3/08

(Continued)

(56) References Cited

U.S. PATENT DOCUMENTS

| | | | | |
|---|---|---|---|---|
| 2,870,445 A * | 1/1959 | Fisher | ..... | A42B 3/14 2/416 |
| 3,025,525 A * | 3/1962 | Larson | ..... | A42B 3/14 2/419 |

(Continued)

FOREIGN PATENT DOCUMENTS

| | | |
|---|---|---|
| DE | 1797962 U | 10/1959 |
| DE | 1997962 U | 6/1968 |

(Continued)

OTHER PUBLICATIONS

International Search Report for International Application No. PCT/EP2011061880, mailed on Nov. 21, 2011.

*Primary Examiner* — Tejash Patel
(74) *Attorney, Agent, or Firm* — Fitch, Even, Tabin & Flannery LLP

(57) ABSTRACT

An interior fitting subassembly is described at least consisting of a supporting cage, a head band and a neck band for a protective helmet. Three support arms serve to fasten the subassembly on a helmet shell with a spacing. Although the support arms conduct a force acting on the helmet into the supporting cage said support arms endeavour to deform the helmet shell. The helmet therefore has an improved shock absorption capability. In addition, the support arms create a clearance between the interior fitting subassembly and the helmet shell or receiving ear protection capsules and supporting brackets of an ear protection and other helmet accessories.

18 Claims, 9 Drawing Sheets

Figure 1:
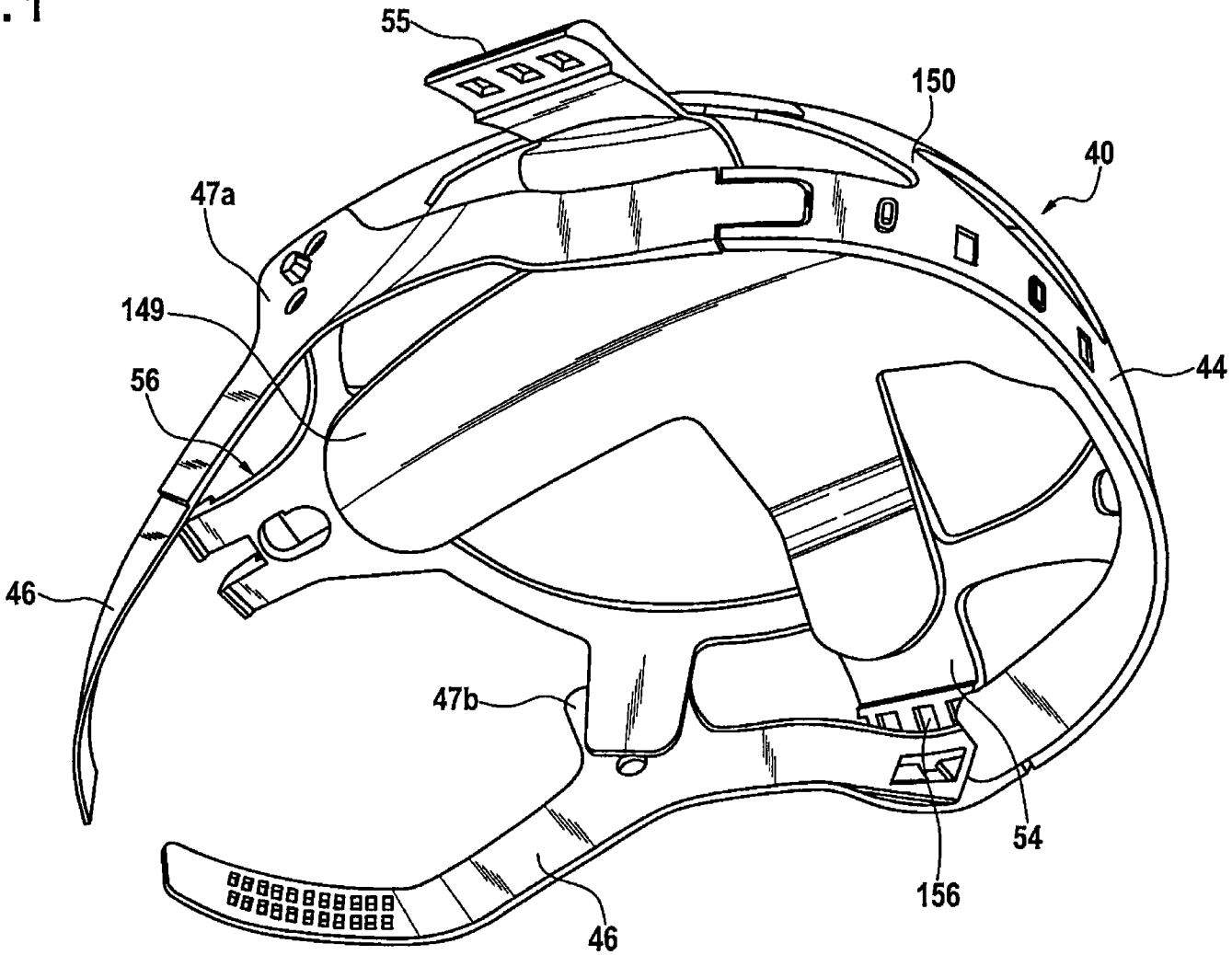

(58) Field of Classification Search
USPC ..... 2/421, 416, 417, 420, 425, 422
See application file for complete search history.

(56) References Cited

U.S. PATENT DOCUMENTS

| | | | | |
|---|---|---|---|---|
| 3,127,615 | A * | 4/1964 | Aileo | A42B 3/14 2/416 |
| 3,175,225 | A * | 3/1965 | Lindblom | A42B 3/14 2/416 |
| 3,388,405 | A | 6/1968 | Simpson et al. | |
| 3,909,846 | A * | 10/1975 | Zahn | A42B 3/14 2/416 |
| 4,224,694 | A | 9/1980 | Palmaer | |
| 4,547,908 | A | 10/1985 | Karlsson et al. | |
| 5,093,936 | A | 3/1992 | Copeland et al. | |
| 7,213,271 | B1 * | 5/2007 | Bielefeld | A42B 3/14 2/181 |
| 8,505,121 | B2 * | 8/2013 | Ahlgren | A42B 3/085 2/417 |
| 9,113,671 | B2 * | 8/2015 | Pfanner | A42B 3/14 |
| 2002/0000004 | A1 | 1/2002 | Wise et al. | |
| 2006/0156448 | A1 | 7/2006 | Garneau et al. | |
| 2007/0261153 | A1 | 11/2007 | Wise et al. | |

FOREIGN PATENT DOCUMENTS

| | | | |
|---|---|---|---|
| DE | 2736530 | A1 | 3/1978 |
| DE | 2907056 | A1 | 8/1980 |
| DE | 3314595 | A1 | 11/1983 |
| DE | 2826636 | C2 | 5/1987 |
| DE | 8714490 | U1 | 9/1988 |
| DE | 3314595 | C2 | 11/1991 |
| DE | 9410596 | U1 | 8/1994 |
| DE | 3590667 | C2 | 9/1996 |
| DE | 29708134 | U1 | 8/1997 |
| DE | 69811738 | T2 | 8/2003 |
| DE | 102004004044 | B4 | 10/2005 |
| EP | 2025255 | A2 | 2/2009 |
| JP | 2007-297743 | A | 11/2007 |
| WO | 2005027671 | A1 | 3/2005 |

* cited by examiner

INTERIOR FITTING FOR A PROTECTIVE HELMET, IN PARTICULAR FOR FORESTRY WORKERS

CROSS-REFERENCE TO RELATED APPLICATIONS

This application is a U.S. National Stage filing under 35 U.S.C. 371 of International Application No. PCT/EP2011/061880, filed Jul. 12, 2011, designating the United States and claims the benefit of foreign priority from German Patent Application Number 10 2010 027 014.8, filed Jul. 13, 2010, the entire disclosures of which are incorporated herein by reference.

The invention relates to interior fittings for a protective helmet, particularly for forestry workers, comprising a supporting cage, a head band and a neck band which together form an interior fitting subassembly which can be fixed on a helmet shell for supporting and retaining the helmet on the head of a wearer.

A protective helmet having interior fittings of this type is known from the document DE 8714490 U1. The protective helmet is comprised of a helmet shell and minimum interior fittings. The interior fittings comprise a textile crossed strap by means of which the helmet is worn on the head and which ensures a shock absorbing distance between the head and the helmet shell. At its outer circumference, the helmet is provided with a protrusion encompassing the lateral and the rear part of the helmet and comprising four recesses for mounting the crossed strap on the lower edge.

From the document DE 10 2004 004 044 B4, a protective helmet is known which comprises a carrier serving as interior fittings for mounting the protective helmet on the head to be protected. A shield is held by the carrier. A head shell is releasably attached to the carrier or the shield. The head shell serves as the actual protection of the skull. Since it can be detached from the carrier or the shield, it may be removed in case of applications in which an endangerment of the skull, for example by falling objects, can be largely excluded. For the user, this means that he may only wear the carrier including the attached shield so that the wearing comfort is improved by the weight reduction alone. Furthermore, the cooling of the head will be improved. It is said to be one advantage here that additional safety equipment can be attached to the shield or the carrier when the user is more in need of protection other than skull protection in specific applications (e.g. soil compaction work). The carrier is made of a flexible material (leather, elastic plastic material, etc.) so as to adjust to the form of the head. Furthermore, it is possible to adjust the carrier in the known manner to make it fit users having different head diameters. The head shell is designed so as to be cup-shaped so that it can cover the upper part the skull of the head not covered by the shield when the head shell is attached to the shield or to the carrier. Preferably, the head shell is directly attached to the carrier so that the forces acting on the protective helmet in case of an impact of objects can be directly transmitted to the user from the head shell via the carrier.

From the document DE 698 11 738 T2, a protective helmet is known in which the interior fittings comprising a subassembly contacting the head and including a supporting cage, a head band, and a neck band are mounted with the aid of anchoring lugs inserted into slots formed in four positions in the lower edge of a double-walled helmet shell. The head band is made of a flexible material which can readily adjust to the size and shape of the head of the wearer.

From the document WO 2005/027671 A1, a safety helmet is known in which a shock absorbing unit surrounding the remaining interior fittings is arranged in the helmet shell. On the inside of the helmet shell, protrusions exist to which the shock absorbing unit and the interior fittings are attachable by means of screws. In this known safety helmet, the shock absorbing unit is designed so thick that it is possible to provide a recess in its outer side facing the interior of the helmet in which a transmitter/receiver having a connecting line leading to the outside may be accommodated.

All aforementioned known protective helmets have in common that an external force acting on the helmet is essentially transmitted in full to the head of the wearer of the helmet via the interior fittings, particularly via a supporting cage formed by a crossed strap. Namely, the crossed strap can only fulfil a shock absorbing function to a certain degree since it has the additional function of firmly retaining the helmet on the head of the wearer. Accordingly, there is also a need for interior fittings for a protective helmet having an improved shock absorption capability.

It is the object of the invention to provide interior fittings of the type mentioned in the beginning and known from the first mentioned document so designed that they provide a protective helmet equipped with them with an improved shock absorption capability, irrespective of the type of helmet, i.e., not only a helmet designed for the use in forestry.

According to the invention, this object is solved by the supporting cage being formed of a stiff, elastically flexible material and being respectively provided with a rigid support arm protruding obliquely downwards or backwards in two temple areas as well as in an area of the back of the head for a three-point attachment of the interior fitting subassembly to the helmet shell and for enabling a clearance continuously extending around the interior fitting subassembly within the helmet shell.

In the interior fittings according to the invention, the supporting and the shock absorbing function are combined in the supporting cage made of a stiff, elastically flexible material. In fulfilling the shock absorbing function, the supporting cage is supported by the helmet shell as the free ends of the arms protruding obliquely downwards or backwards support the helmet shell on the supporting cage so that in case of an external pressure acting on the helmet shell from above, the support arms are subjected to a tensile load by the helmet shell and attempt to deform the helmet shell towards the inside. A protective helmet equipped with the interior fittings according to the invention has an overall better shock absorption capability so that less force is transmitted to the head of the wearer.

Advantageous embodiments of the interior fittings according to the invention constitute the subject matter of the subclaims.

In one embodiment of the interior fittings according to the invention, the supporting cage is an integral plastics moulding. The shock absorption effect of the supporting cage can be more readily controlled in this way than in case of the supporting cage comprised of a textile crossed strap as in the state of the art.

In a further embodiment of the interior fittings according to the invention, the supporting cage is formed of a plastic material such as polyamide. In this way, the supporting cage has the required stiffness and is however sufficiently elastic for the shock absorption.

In a further embodiment of the interior fittings according to the invention, the supporting cage is formed of two pairs of mutually spaced apart supporting strips which intersect in the centre and blend into in a single, peripherally closed supporting strip at four connecting points at their outer ends. In this way, the supporting cage retains sufficiently large orifices for the ventilation of the head but is supported on a sufficiently large area on the head to provide for a comfortable yet firm fit of the helmet on the head and to form a sufficiently stable support for the support arms.

In a further embodiment of the interior fittings according to the invention, the support arms project from the supporting cage at the connecting points. In this way, the supporting cage forms a support for the support arms in the positions where it is the stiffest.

In a further embodiment of the interior fittings according to the invention, the support arms are integrally formed on the peripherally closed supporting strip. In this way, it is ensured that the force is transmitted to the supporting cage by the support arms over the entire circumference of the supporting cage, whereby stress peaks are avoided.

In a further embodiment of the interior fittings according to the invention, the head band is integrally formed on the supporting cage. In this way, the head band contributes to the reinforcement of the supporting cage.

In a further embodiment of the interior fittings according to the invention, the neck band has two ends releasably connected to free ends of the head band and two free ends releasably connectable to each other in the neck area. In this way, the neck band forms an integral part of the interior fittings but can be equipped with further helmet accessories in the form of a tightening unit in a simple manner. To this end, the two free ends of the neck band only have to be connected to the tightening unit.

In a further embodiment of the interior fittings according to the invention, the neck band is formed of the same material as the supporting cage. In this way, the production of the interior fittings and the adjustment of their shock absorption capability are facilitated.

In a further embodiment of the interior fittings according to the invention, the neck band is respectively connected to the supporting cage between its connections to the head band and its free ends so as to be adjustable in height. In this way, the fit of a protective helmet equipped with the interior fittings according to the invention can be improved in a simple way.

In a further embodiment of the interior fittings according to the invention, the supporting cage comprises two supporting arms protruding downwards on which the neck band is respectively fixable in a selectable height. Since the selectable fixation of the neck band is realized on supporting arms which are part of the supporting cage, the interior fittings remain a self-contained subassembly irrespective of the height in which the neck band is fixed on the supporting arms.

In a further embodiment of the interior fittings according to the invention, the supporting arms are integrally formed on the supporting cage. In this way, the stability of the interior fittings as a whole is improved, which in turn facilitates the determination of its shock absorption capability.

In a further embodiment of the interior fittings according to the invention, the head band is integrally formed on the peripherally closed supporting strip in a distance from the peripherally closed supporting strip via connecting strips. In this way, the head band can fulfil its function to support the interior fittings on the forehead irrespective of the design of the supporting cage.

In a further embodiment of the interior fittings according to the invention, the support arms and the supporting arms are further reinforced by integrally formed ribs. In this way, the force transmission via the support arms and the supporting arms is improved.

In a further embodiment of the interior fittings according to the invention, the support arms protruding downwards in the two temple areas comprise means for a fixation on the helmet shell. In this way, the interior fittings according to the invention are mountable on any helmet. The only precondition is that its helmet shell is provided with complementary fixation means on the inside or comprises slots in which the fixation means of the downwards protruding support arms can engage so that the support arms can be subjected to a tensile load by the helmet shell.

In a further embodiment of the interior fittings according to the invention, the fixation means is formed so that it can be brought in a positive engagement with the helmet shell. It should not be a problem to provide the helmet shell of any type of protective helmet with slots suitable for this purpose as early as during production.

In a further embodiment of the interior fittings according to the invention, the support arm protruding backwards a in the area of the back of the head comprises a locking device for a fixation to the helmet shell. In the simplest case, it is sufficient that the helmet shell has an associated slot in which the backwards protruding support arm can be locked by means of a locking device so as to be capable of transmitting a force via the mounting position.

In a further embodiment of the interior fittings according to the invention, a device for fastening a chin strap is formed on the supporting cage. The interior fittings according to the invention enable the chin strap to be directly fastened to the supporting cage owing to their inherent stiffness and their design.

Figure 2:
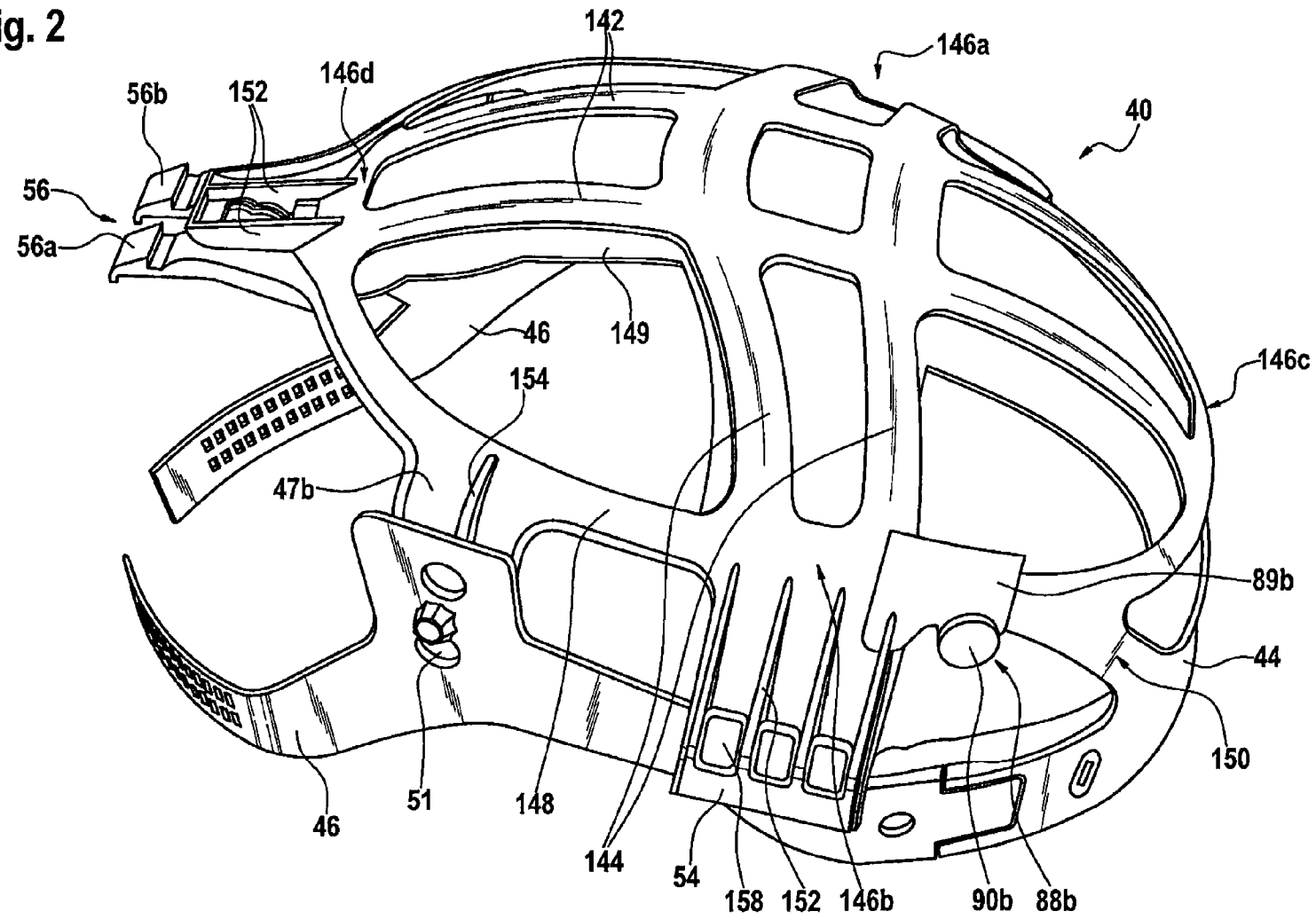
Figure 3:
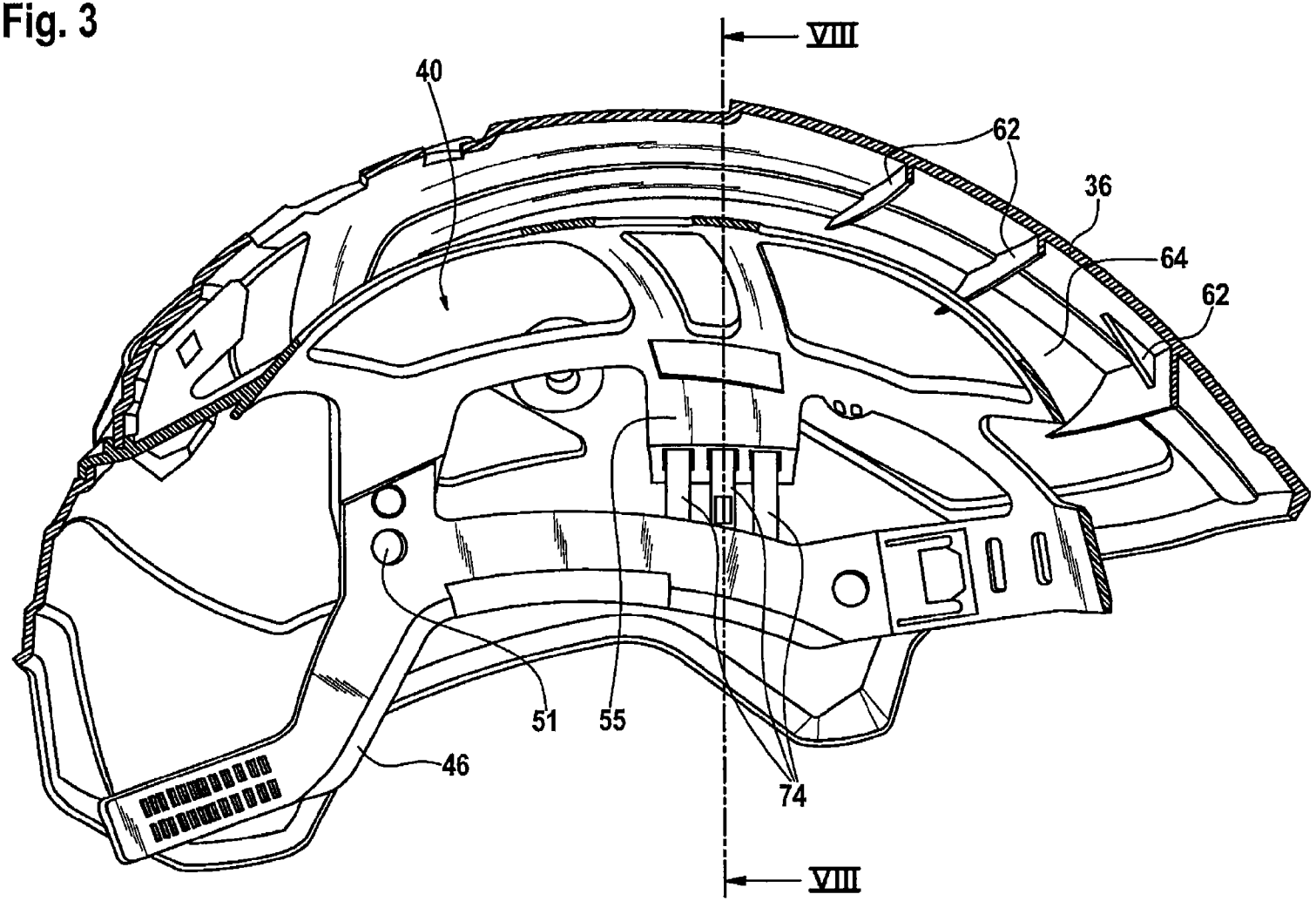
Figure 4:
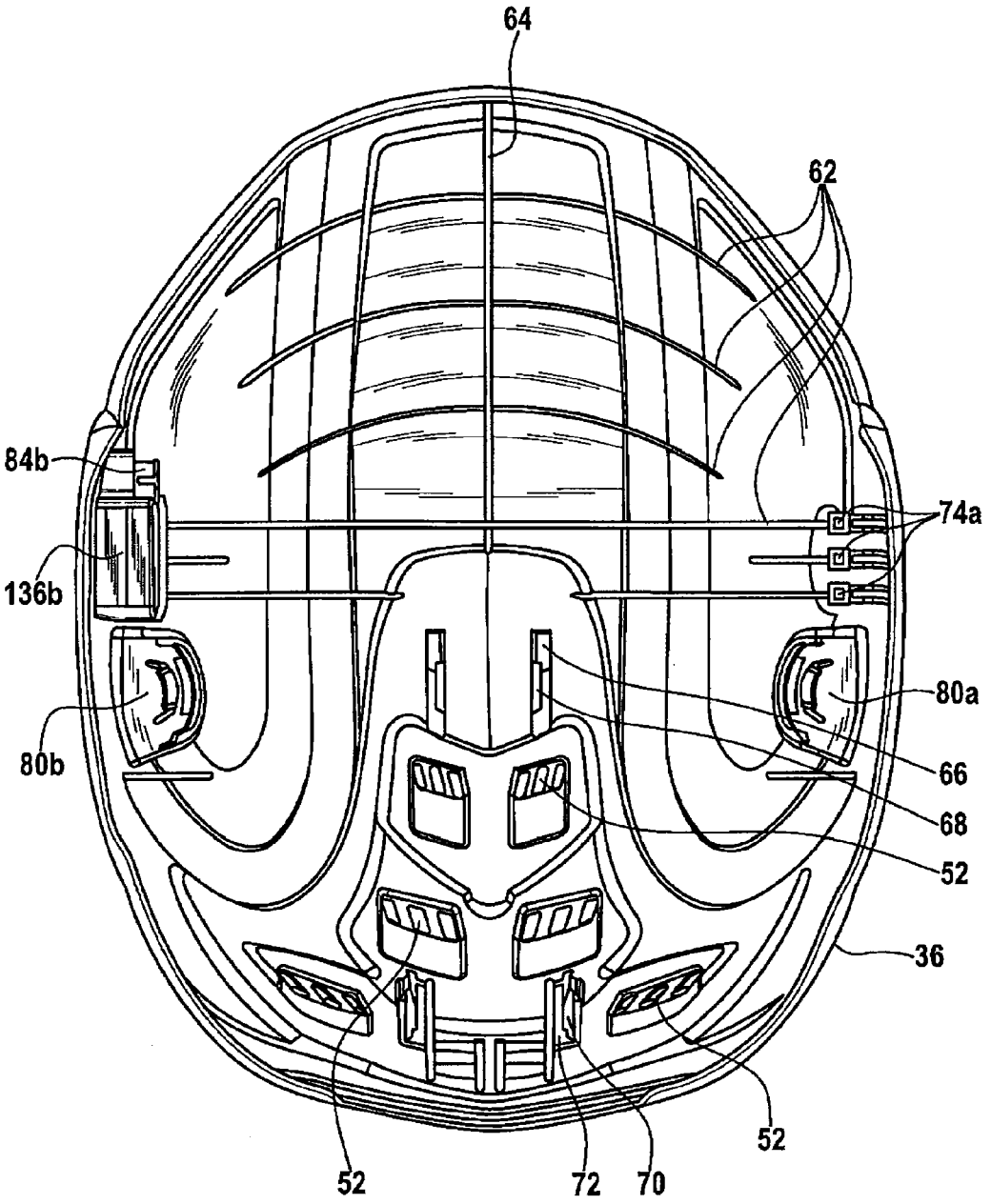
Figure 5:
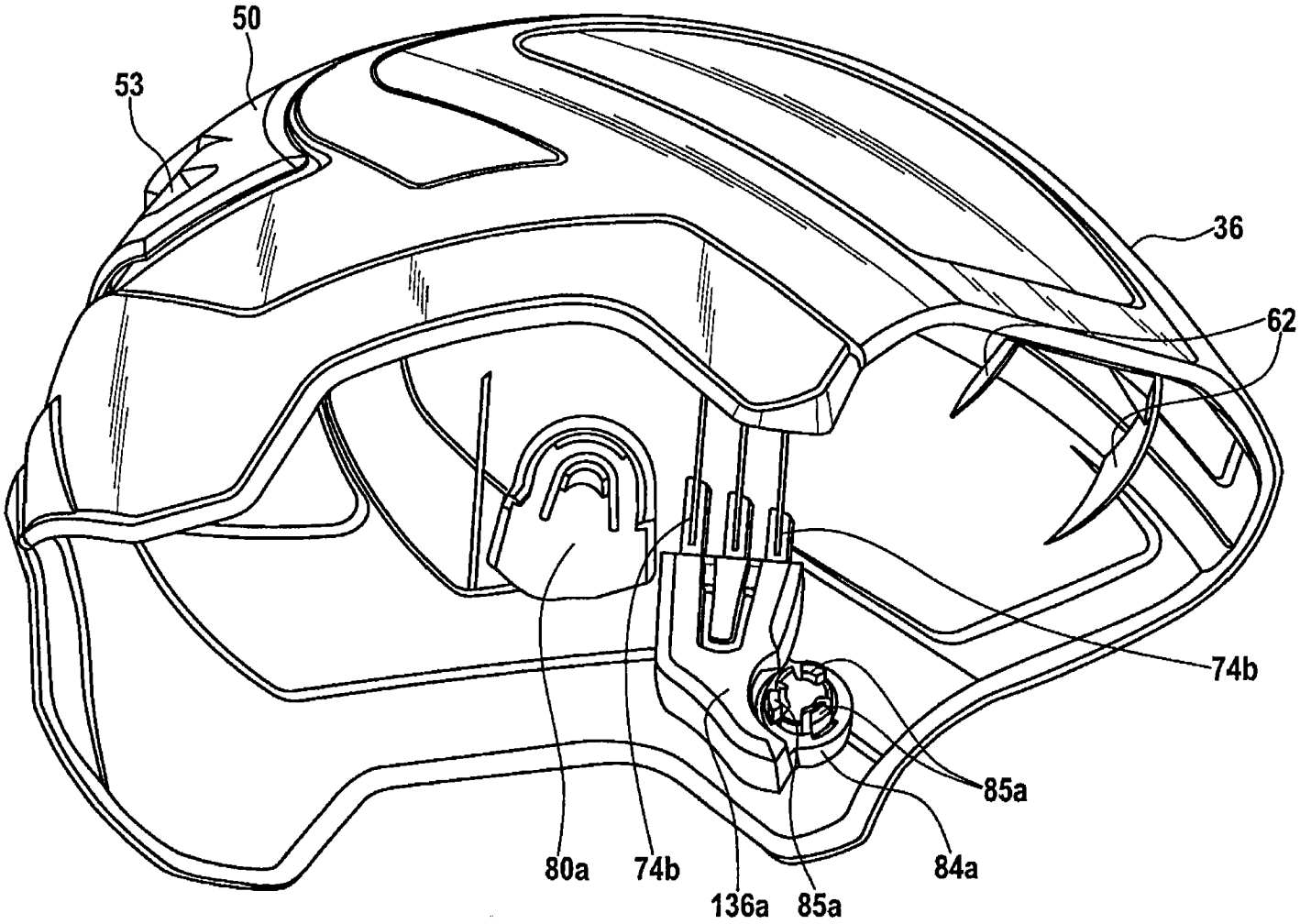
Figure 6:
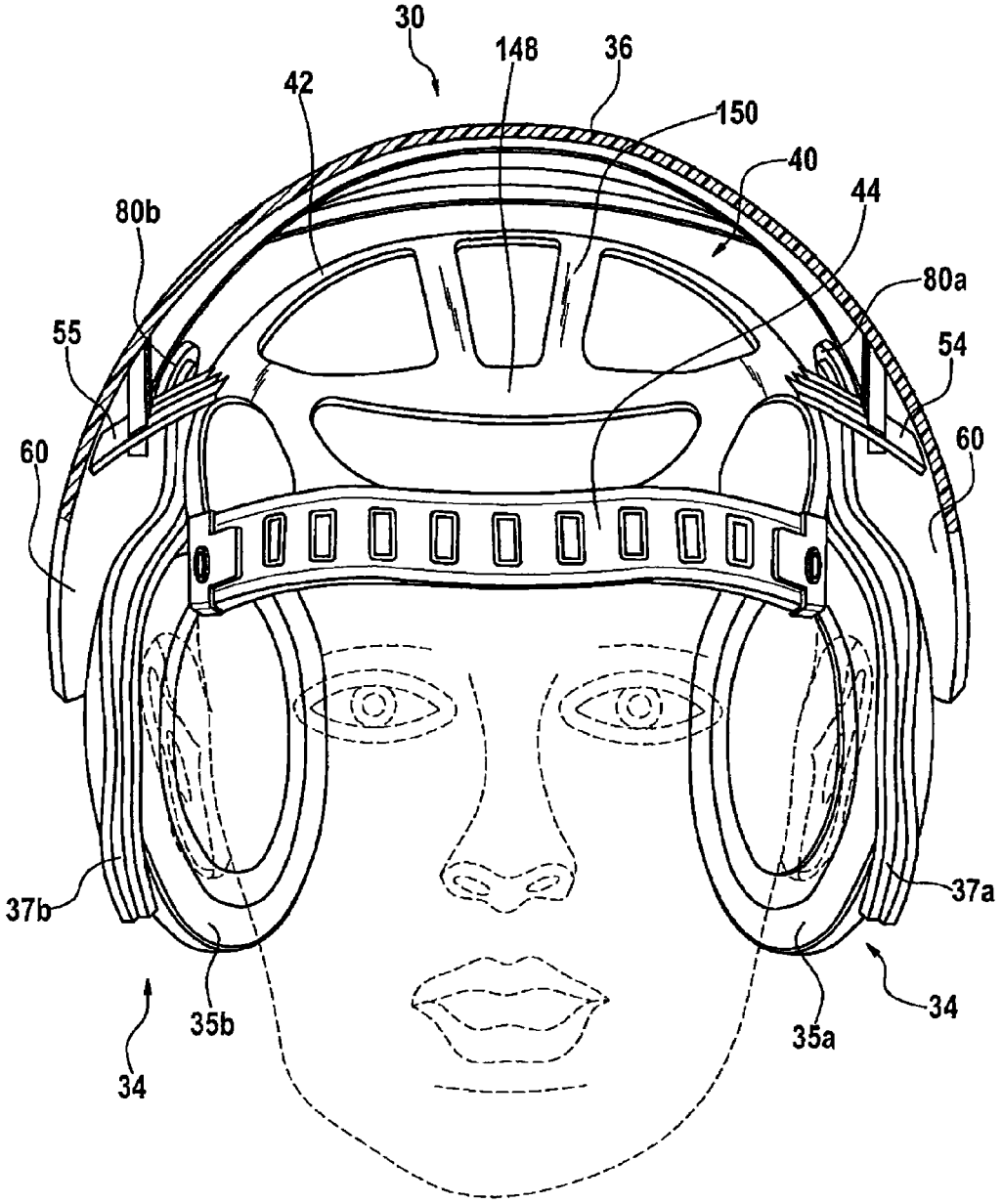
Figure 7:
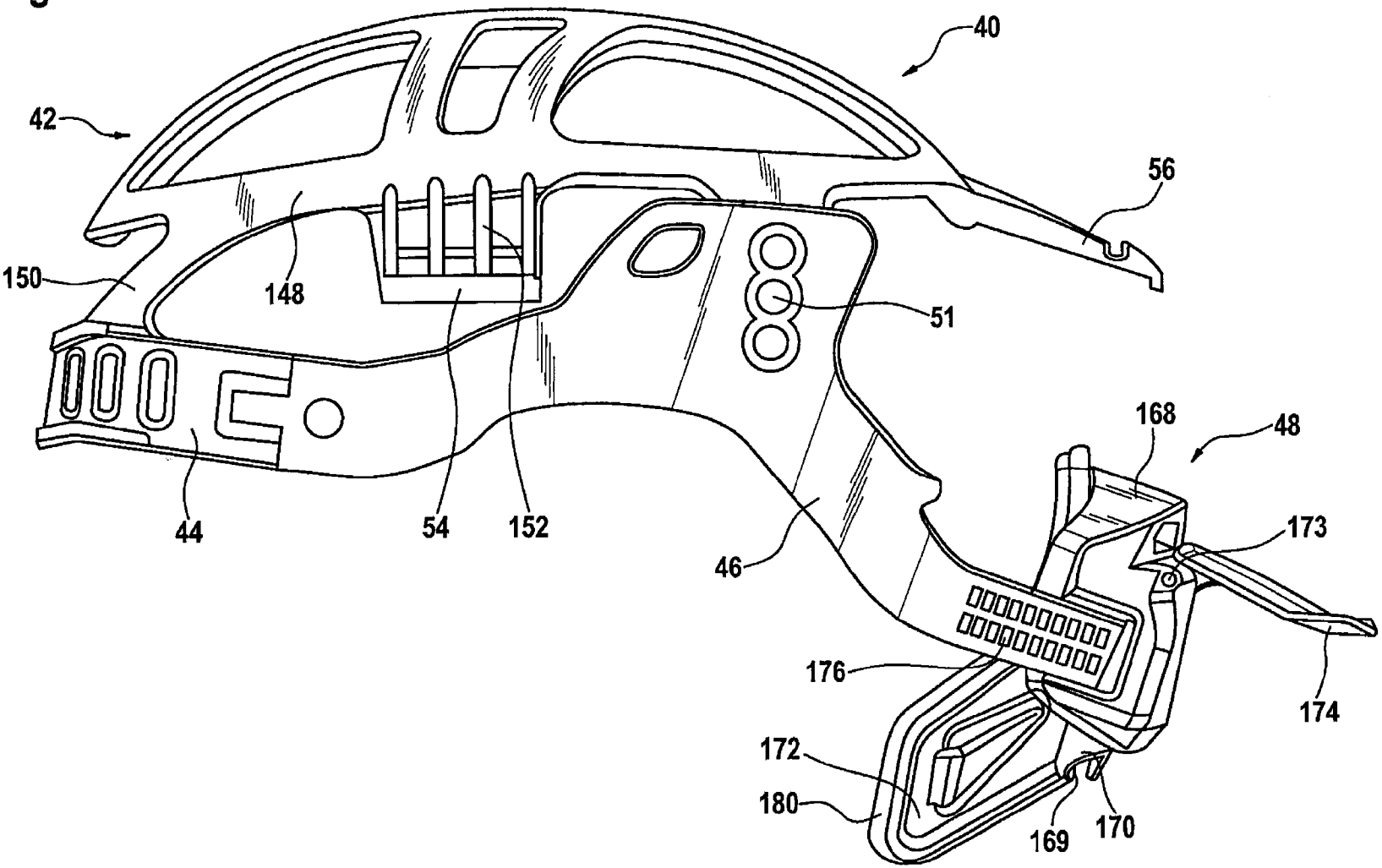
Figure 8:
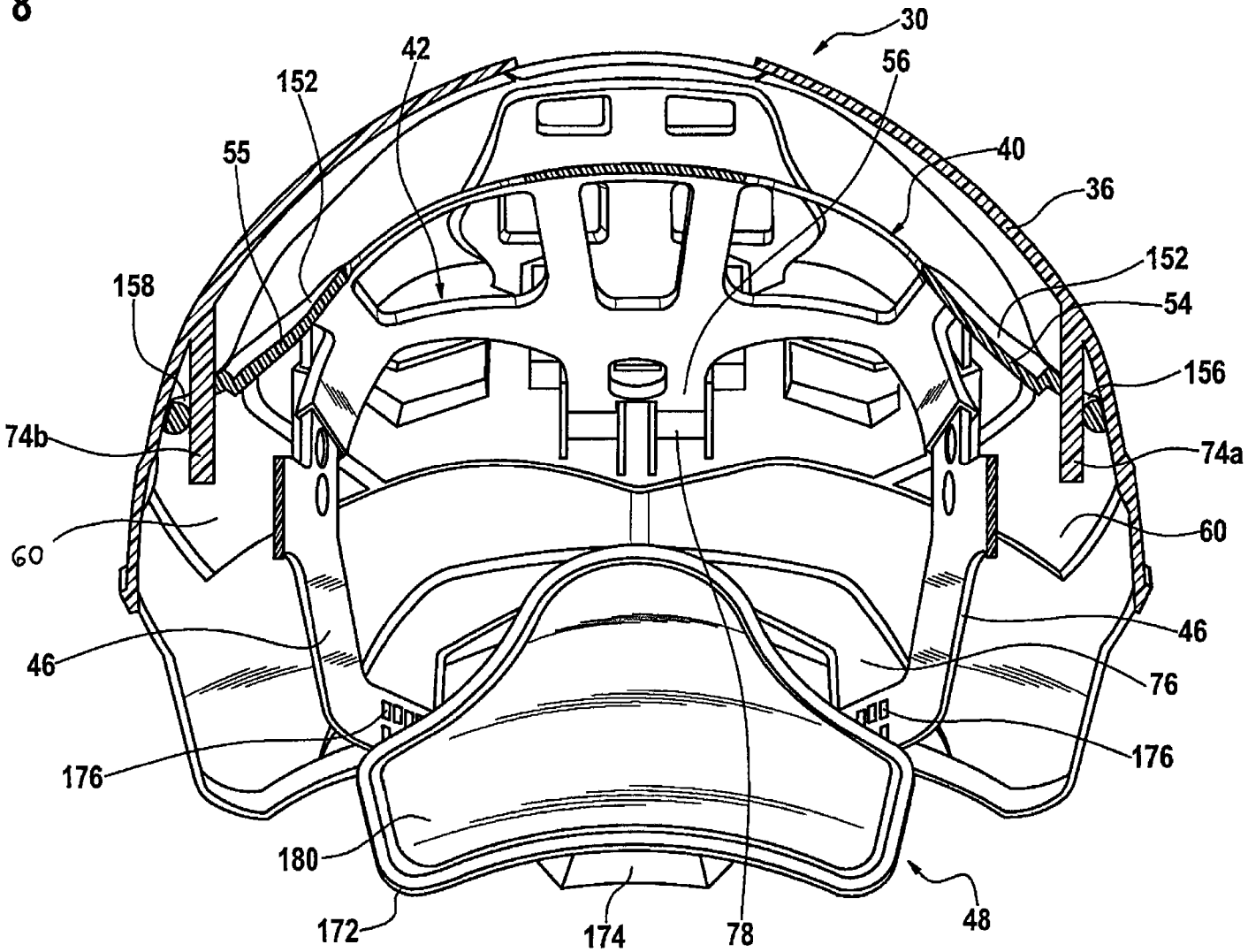
Figure 9:
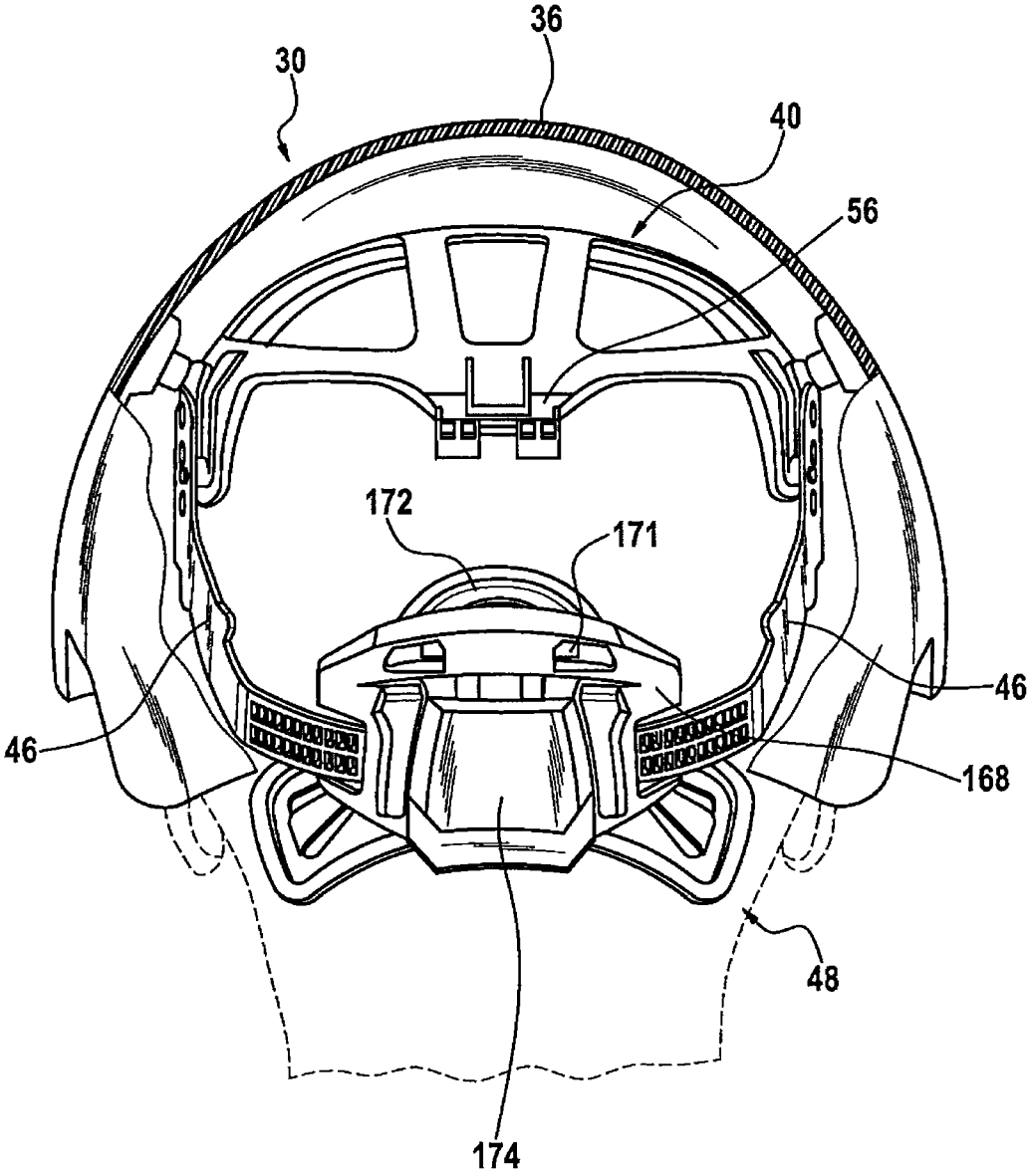

Embodiments of the invention will be described in more detail below with reference to the drawings in which:

FIG. 1 shows an interior fitting subassembly according to the invention for a protective helmet in a perspective illustration and in an inclined view from below, FIG. 2 shows the interior fitting subassembly according to FIG. 1 in an inclined view from above, FIG. 3 shows a longitudinal sectional view of the interior fitting subassembly according to FIG. 1 inserted in a helmet shell of a protective helmet also shown in a longitudinal sectional view, FIG. 4 shows the helmet shell according to FIG. 3 without the interior fitting subassembly in a view from below, FIG. 5 shows the helmet shell according to FIG. 4 in a perspective representation in an inclined view from below, FIG. 6 shows the mount of the interior fittings according to FIGS. 1-3 on a helmet shell of a protective helmet provided with an ear protection shown in a cross-sectional view, FIG. 7 shows the interior fitting subassembly according to the invention in which the two ends of a neck band are releasably connected by a tightening unit in the neck area, FIG. 8 shows a cross-sectional view as viewed in the rearward direction of the interior fitting subassembly according to the invention mounted in a helmet shell, and FIG. 9 shows a partly broken representation as viewed in the forward direction of the interior fittings including the helmet shell according to FIG. 8.

According to the illustration in FIGS. 1-3 and 7, an interior fitting subassembly designated by 40 in its entirety comprises a supporting cage 42, a head band 44, and a neck band 46. The neck band 46 may, according to the representation in FIG. 7, be equipped with a tightening unit designated by 48 as a whole. FIGS. 3-5 show a helmet shell 36 prepared for the installation of the interior fitting subassembly 40.

Three support arms 54, 55 and 56 formed as spacers, the support arm 55 not being visible in FIG. 7, serve as means for a three-point attachment of the interior fittings or the interior fitting subassembly 40 to the helmet shell 36. Under consideration of the dimensions of the helmet shell 36, the support arms 54, 55 and 56 are dimensioned and arranged so that a clearance 60 for accommodating ear protection capsules 35*a*, 35*b* and supporting brackets 37*a*, 37*b* of an ear protection 34 shown in FIG. 6 and other helmet accessories such as the tightening unit 48 of the neck band 46 according to FIG. 7 is present between the interior fitting subassembly 40 and the helmet shell 36.

In the following, the helmet shell 36, the interior fitting subassembly 40 according to the invention, their connection to the helmet shell 36, and then the tightening unit 48 will be described in detail and in this order.

The helmet shell 36 of a helmet 30 will, in the following, be described in detail with reference to the drawings, particularly to FIGS. 3-6, 8, and 9. The helmet shell 36 is not part of the invention. It is only an example of how and where the interior fittings according to the invention can be deployed in an arbitrary helmet selected as an example.

The helmet shell 36 is formed as an integral plastics moulding. A suitable plastic material for the helmet shell 36 is, e.g., ABS. In FIG. 3, the helmet shell 36 equipped with the interior fitting subassembly 40 is shown in a longitudinal sectional view. FIG. 4 shows the helmet shell 36 according to FIG. 3 without the interior fitting subassembly 40 in a view from below. FIG. 5 shows a perspective illustration of the helmet shell according to FIG. 4 in an inclined view from below. On the inner surface of the helmet shell 36, obliquely extending reinforcing ribs 62 are integrally formed in the front and in the central section of the helmet. Transverse to the reinforcing ribs 62 and in the centre, a reinforcing rib 64 extending in the longitudinal direction of the protective helmet 30 is formed. The reinforcing ribs 62 and 64 can be best seen in FIGS. 3 and 4. In the central area, the reinforcing ribs 62, 64 follow an area slightly indented towards the inside which comprises six groups of ventilation orifices 52. In the indented area, a ventilation slide 50 engaging in two front guiding slots 66 with retaining knobs 68 protruding downwards and inwards and in two rear guiding slots 72 with two retaining knobs 70 is shiftably arranged on the outer surface of the helmet shell 36. The ventilation slide 50 has congruent ventilation orifices located above the ventilation orifices 52 in the ventilation position and being displaced in the closed position so that the ventilation orifices 52 are closed by the ventilation slide 50. The lower edge of the helmet 30 is laterally drawn downwards in the area of the temples and in the area of the back of the head as can be seen in FIG. 5. The clearance 60 between the interior fitting subassembly 40 and the helmet shell 36 already mentioned above is, in this way, enlarged towards the bottom in these area. This facilitates the installation of mounting devices on the inside of the helmet shell 36 and the accommodation of the ear protection capsules 35*a*, 35*b* in the clearance 60.

In the abovementioned temple area, three rod-like protrusions 74*a* or 74*b* on which the interior fitting subassembly 40 including the support arms 54 or 55 can be positively and releasably mounted are integrally formed or otherwise mounted on each side on the inside of the helmet shell 36. The rod-like protrusions 74*a*, 74*b* can be seen in a side view in FIG. 5, in a plan view in FIG. 4 (on the right side), and in a sectional view in FIG. 8. The rod-like protrusions 74*a*, 74*b* are respectively square domes or hollow profile parts in the cross-sectional view, the base section of which is integrally formed on the inside of the helmet shell 36. In the area opposite to the base section, the rod-like protrusions 74*a*, 74*b* are arranged so as to be freely standing in front of the inner surface of the helmet shell 36. The connection of the rod-like protrusions 74*a* and 74*b* to the inside of the helmet shell 36 and their junction to the helmet shell in the area adjacent to the connecting point in a respectively triangular knuckle is reinforced by additional ribs integrally formed between the rod-like protrusions 74*a*, 74*b* and the helmet shell 36 so that the rod-like protrusions 74*a*, 74*b* are substantially rigidly connected to the helmet shell 36. If a force transverse to their longitudinal direction and attempting to bend the rod-like protrusions is applied to the rod-like protrusions 74*a*, 74*b*, the rod-like protrusions 74*a*, 74*b* attempt to deform the helmet shell 36 accordingly. The purpose of this design is discussed in more detail further below in connection with the description of the installation of the interior fitting subassembly 40 on the helmet shell 36.

At the rear end, the helmet shell 36 is provided with a recess 76 at the lower edge in the centre behind which the tightening unit 48 of the neck band 46 is located and thereby accessible for a manual operation for tightening or releasing the neck band 46 when the helmet 30 is fully assembled.

To lock the supporting arm 56 on the helmet shell 36, said shell is provided with a slot 78 in the area of the back of the head in which the correspondingly formed free end of the supporting arm 56 (FIG. 2) can releasably engage as can be seen in FIGS. 7 and 8. When the support arm 56 is engaged, protrusions 56*a*, 56*b* formed on the support arm 56 are located outside of the helmet shell 36 and abut to its outer surface so that a tensile load is applied to the support arm 56 when a force acts on the helmet shell 36 from above.

The interior fittings for the protective helmet 30 are described in detail below with reference to the drawings, particularly to FIGS. 1-3 and 7. The interior fitting subassembly 40 is generally the part of a protective helmet which contacts the head and is comprised of the supporting cage 42, the head band 44, and the neck band 46 equipped with the tightening unit 48. The subassembly 40 is mountable to the helmet shell 36 shown in FIGS. 4 and 5 to support and retain the helmet 30 on the head of a wearer.

FIG. 1 shows the interior fitting subassembly 40 of the protective helmet 30 in a perspective illustration and in an inclined view from below. FIG. 2 shows the interior fitting subassembly according to FIG. 1 in an inclined view from above. FIG. 3 shows a longitudinal sectional view of the interior fitting subassembly 40 according to FIG. 1 inserted in the helmet shell 36 of the protective helmet 30 also shown in a longitudinal sectional view. FIG. 7 shows the interior fitting subassembly 40 of the protective helmet 30, two ends of the neck band 46 being releasably connected by the tightening unit 48 in the neck area.

The supporting cage 42 is formed of a stiff, elastically flexible material, preferably of a plastic material such as polyamide. The supporting cage 42 is respectively provided with a rigid support arm 54, 55, or 56 protruding obliquely downwards or backwards in two temple areas as well as in an area of the back of the head for a three-point attachment of the interior fittings to the helmet shell 36 and for enabling the clearance 60 continuously extending around the interior fittings in the helmet shell 36 to accommodate the ear protection capsules 35*a*, 35*b* of the ear protection 32 and other helmet accessories. In the embodiment described here, the supporting cage 42 is produced as an integral plastics moulding. The supporting cage 42 is formed by two pairs of mutually spaced apart supporting strips 142, 144 which, according to the representation in FIG. 2, intersect in the centre and blend into in a single, peripherally closed supporting strip 148 at their lower ends at four connecting points 146*a*, 146*b*, 146*c*, 146*d*. In FIG. 1, the supporting strip 142, 144 is covered by a cross-shaped piece of padding material 149.

The support arms 54, 55, 56 protrude from the supporting cage 42 at the connecting points 146*a*, 146*b*, 146*c*. If it is assumed that the supporting strips 142 and 144 extend in a curve, preferably substantially in a circular arc between the connecting points 146*a*, 146*b* or 146*c*, 146*d*, the supporting arms 54, 55 or 56 protrude, respectively, downwards or backwards from the supporting cage 142 substantially at a tangent to the associated arcas can be seen in FIGS. 8 or 2. In the embodiment described here, the support arms 54, 55, 56 are integrally formed on the peripherally closed supporting strip 148. The head band 44 is integrally formed on the supporting cage 42 as can be seen in FIG. 2. The neck band 46 has two front ends releasably connected to rear free ends of the head band 44, for example, by a snap-on connection not shown in detail in the Figures. The neck band 46 has, according to the representation in FIGS. 1 to 3, two free ends releasably connectable to each other in the neck area, namely with the aid of the tightening unit 48 as can be seen in FIG. 7.

The neck band 46 may be made of the same material as the supporting cage 42. The neck band 46 is respectively connected to the supporting cage 42 between its connections to the head band 44 and its free ends so as to be adjustable in height as can be seen, for example, in FIGS. 1 and 2. For this purpose, the supporting cage 42 comprises two supporting arms 47*a*, 47*b* protruding downwards on which the neck band 46 can respectively be fastened in a selectable height. The neck band 46 has three holes 51 arranged one above the other on each side which can be brought in engagement with resilient bolts protruding from each supporting arm 47*a*, 47*b*, as can be seen in FIGS. 1 and 2.

The head band 44 is integrally formed on the peripherally closed supporting strip 148 via connecting strips 150 in a distance to the peripherally closed supporting strip 148. The support arms 54, 55, 56 and the supporting arms 47*a*, 47*b* are further reinforced by integrally formed ribs 152 or 154.

The support arms 54, 55 protruding downwards in the two temple areas comprise means for a fixation on the inside of the helmet shell 36. The fixation means comprises three through-holes 156 or 158 in each of the support arms 54, 55 which can be brought in a positive engagement with the rod-like protrusions 74*a* or 74*b* on the helmet shell 36. The supporting arm 56 of the supporting cage 42 protruding backwards in the area of the back of the head comprises the protrusions 56*a*, 56*b* which, as already explained above, form a locking device for releasably fixing the interior fitting subassembly 40 on the helmet shell 36.

According to FIG. 2, finally, a device 88*a*, 88*b* for mounting a chin strap (not shown) is formed on the supporting cage 42. The chin strap fastening device 88*a*, 88*b* comprises two pivot pins 90*a*, 90*b* integrally formed on the peripherally closed supporting strip 148 of the supporting cage 42 adjacent to the support arms 54, 55 protruding downwards in the two temple areas or, as shown, on an intermediate piece 89*a*, 89*b* attachable to the peripherally closed supporting strip 148.

In industrial and forestry workers' helmets, the chin strap is attached to the helmet shell (not shown) or to the supporting cage 42. In mountaineers' helmets, the chin strap is only attached to the helmet shell.

The mutual connection of the helmet shell 36 and the interior fitting subassembly 40 partially also already described above will be discussed in summary and supplementary here with reference to FIGS. 2, 3 and 7. FIG. 2 shows the interior fitting subassembly 40 in a perspective illustration and in an inclined view from above. FIG. 3 shows a longitudinal sectional view of the interior fitting subassembly 40 inserted in the helmet shell 36 of the protective helmet 30 also shown in a longitudinal sectional view, the tightening unit 48 on the neck band 46 not being shown.

FIG. 8 shows a sectional view of the protective helmet 30 along the line VIII-VIII in FIG. 3, the tightening unit 48 also being shown. In FIG. 2, the support arms 55 and 56 formed as spacers can be seen. The second support arm 55 protruding downwards is not visible in FIG. 2. The support arm 55 can be seen in an interior view in FIG. 3.

In FIG. 8, the support arms 54 and 55 are shown in a cross-sectional view. For a three-point attachment of the interior fitting subassembly 40 on the helmet shell 36 the supporting arm 56 protruding backwards is inserted into the slot 78 in the helmet shell until the protrusions 56*a*, 56*b* are locked on the outside the helmet shell. The interior fitting subassembly 40 is then moved further inwards in the direction of the inner surface of the helmet shell 36, the supporting arms 54 and 55 being slipped over the rod-like protrusions 74*a* or 74*b*. In the process, the through-holes 156 and 158 in the support arms 54 and 55 positively accommodate the rod-like protrusions 74*a* or 74*b* as can be seen in FIG. 8. If the support arms 54, 55 abut on the inside of the helmet in the knuckle between the helmet shell 36 and the rod-like protrusions 74*a*, 74*b*, the connectors 136*a* and 136*b* (FIGS. 4 and 5) are fit onto the rod-like protrusions 74*a* or 74*b* to thereby fix the support arms 54 and 55 in their positions. The interior fitting subassembly 40 and the helmet shell 36 are now fixedly connected to each other at three points. As soon as the protective helmet 30 is put on the head and fastened to the head with the aid of the tightening unit 48, in addition, a chin strap (not shown) may be fastened under the chin, if required. The through-holes 156, 158 in the supporting arms 54, 55 receive, respectively, the rod-like protrusions 74*a* or 74*b* at a length at least equal to the inner width of the through-holes 156, 158. If a load is applied to the helmet 30 from above, a force is exerted on the support arms 54, 55, 56, and a tensile load is applied to the support arms by the helmet shell 36 supported by the ends of the support arms. A momentum attempting to deform the helmet shell 36 towards the inside at each of the three points on lower edge is generated by this force acting on the support arms 54, 55, 56. In this way, the helmet shell 36 transforms part of the deformation energy acting on it and thus reduces the force effect on the person wearing the helmet. The transmission of the momentum from the support arms 54, 55, 56 to the helmet shell 36 is further intensified by the support arms being further reinforced by integrally formed ribs 152.

In the embodiment described above, the support arms 54, 55 are mounted to the helmet shell 36 in a different way than the support arm 56, but this is not necessarily required. The support arms 54, 55 may also be attached to the helmet shell in the same way as the support arm 56. It is only required that the support arms 54, 55 comprise the same fixation means as the support arm 56 which enable the establishment of a positive engagement of the support arms 54, 55 on the helmet. In this case, the fixation means of the support arms 54, 55 would also be snap-on means to be inserted into, e.g., slots in the helmet shell 36 to secure the support arms 54, 55 as well as the support arm 56 on the helmet shell by means of a snap-on connection.

In the following, the ear protection 34 including its mounting device 80 will be briefly described with reference to FIG. 6. FIG. 6 shows the protective helmet 30, the ear protection 34 being shown when pivoted onto the ears. The ear protection 34 comprises the two ear protection capsules 35*a*, 35*b* which are respectively pivotably supported in the fork-like supporting bracket 37*a*, 37*b*. The helmet shell 36 is provided with fixed ear protection supporting points 80*a*, 80*b* on its inside as shown in FIG. 4. The supporting brackets 37*a*, 37*b* provided with the ear protection capsules 35*a* or 35*b* are pivotably supported in the supporting points 80*a*, 80*b*. The ear protection supporting points 80*a*, 80*b* and the supporting bracket 37*a*, 37*b* are arranged and formed so that the supporting brackets 37*a*, 37*b* are pivotable between two positions in the clearance 60, an operating position shown in FIG. 6 in which the ear protection capsules 35*a*, 35*b* cover the ears, and a parking position (not shown) in which the ear protection capsules 35*a*, 35*b* accommodated in the clearance 60 in the helmet shell 36 behind the ears.

A face protection (not shown) comprises a visor comprising two retaining arms for the accommodation of which two connectors 136*a*, 136*b* are provided which are shown in FIGS. 5 or 4. A face protection supporting point 84*a* or 84*b* is respectively integrally formed on the connectors 136*a*, 136*b* as a mounting device for the face protection. The connectors 136*a*, 136*b* are fit onto the rod-like protrusions 74*a* or 74*b* whereby the face protection supporting points 84*a*, 84*b* come to rest on the inside of the helmet shell 36 in the temple area.

In the following, the tightening unit 48 already briefly mentioned above will be described in more detail with reference to FIGS. 7-9. The tightening unit 48 is, along with the ear protection 34, a further helmet accessory which, like the ear protection 34, is always positioned within the perimeter of the helmet shell 36 so that the helmet 30 does not have any protruding parts in the area of the tightening unit 48 either. FIG. 7 shows a side view of the interior fitting subassembly 40 of the protective helmet 30 in which the two ends of the neck band 46 are releasably connected by the tightening unit 48 in the neck area, the tightening unit 48 being shown tightened state in FIG. 7. FIG. 8 shows a cross-sectional view of the protective helmet 30 as viewed in the rearward direction. FIG. 9 shows a partly broken representation of the protective helmet 30 as viewed in the forward direction.

The tightening unit 48 comprises a mount 168 into which the free ends of the neck band 46 are inserted on both sides. The mount 168 has angular knobs which can be brought into engagement with angular orifices 176 of the neck band 46. In this way, the length of the neck band 46 can be roughly adjusted depending on t he size of the head. The adjustment is appropriately carried out so that the protective helmet 30 can be conveniently put on when the tightening unit is not operated. The tightening of the neck band 46 after the helmet 30 is put on will then take place with the aid of the tightening unit 48 as explained below.

The operation of the tightening unit 148 is effected by means of a locking flap 174 which, according to FIG. 7, is connected to the mount 168 by a joint 173. Between the mount 168 and the supporting shell 172 a transfer lever 169 is located, of which only the lower end of a supporting fork 170 is seen in FIG. 7 which is mounted on the rear side of the supporting shell 172. The upper end of the mount 168 is jointedly connected to the upper end of the transfer lever 169. The supporting shell 172 is jointedly connected to the lower end of the transfer lever 169 by the supporting fork 170, these two jointed connections not being shown in detail in FIG. 7. The locking flap 174 is provided on the inside with a cam supported on the rear side of the transfer lever 169 which is not visible in the drawings. When the locking flap 174 is moved into the closed position shown in FIG. 7 by the action of the cam, the lower end of the mount 168 is pivoted backwards. With this pivoting movement, the neck band 46 is tightened. In the process, the tightening unit 48 is supported by the supporting shell 172 on the back of the head in the neck area.

If the locking flap 174 is pivoted counter clockwise and thus opened, the tightening unit 48 is opened. In this way, the lower edge of the mount 168 can be moved in the direction of the supporting shell 172 so that the neck band 46 is released, and the protective helmet 30 can be put on or taken off. If the protective helmet 30 is put on, the locking flap 174 only has to be pivoted downwards to fasten the helmet 30 on the head. This can be conveniently done with one hand and even with a glove. The supporting shell 172 is covered by a piece of padding material 180 on the front side.

The invention claimed is:

1. Interior fittings for a protective helmet, comprising several supporting strips connected to a head band, and a neck band connected to the head band, wherein the several supporting strips, the head band, and the neck band together form an interior fitting subassembly fixable to a helmet shell for supporting and retaining the helmet on the head of a wearer, wherein the several supporting strips form a supporting cage which is formed of a stiff, elastically flexible material and is respectively provided with rigid support arms protruding obliquely downwards or backwards in two temple areas as well as in an area of the back of the head for a three-point attachment of the interior fitting subassembly to the helmet shell and for enabling a clearance continuously extending around the interior fitting subassembly within the helmet shell.

2. The interior fittings according to claim 1, wherein the supporting cage is an integral plastics moulding.

3. The interior fittings according to claim 2, wherein the supporting cage is formed of polyamide.

4. The interior fittings according to claim 1, wherein the supporting cage is formed of two pairs of mutually spaced apart supporting strips which intersect in the centre and blend into a single, peripherally closed supporting strip at their outer ends at four connecting points.

5. The interior fittings according to claim 4, wherein the support arms protrude from the supporting cage at the connecting points.

6. The interior fittings according to claim 4, wherein the support arms are integrally formed on the peripherally closed supporting strip.

7. The interior fittings according to claim 4, wherein the head band is integrally formed on the supporting cage.

8. The interior fittings according to claim 7, wherein the neck band has two ends releasably connected to free ends of the head band and two free ends releasably connectable to each other in the neck area.

9. The interior fittings according to claim 1, wherein the neck band is formed of the same material as the supporting cage.

10. The interior fittings according to claim 8, wherein the neck band is respectively connected to the supporting cage so as to be adjustable in height between its connections to the head band and its free ends.

11. The interior fittings according to claim 10, wherein the supporting cage further comprises two supporting arms protruding downwards on which the neck band is respectively fixable in a selectable height.

12. The interior fittings according to claim 11, wherein the supporting arms are integrally formed on the supporting cage.

13. The interior fittings according to claim 12, wherein the head band is integrally formed on the peripherally closed supporting strip via connecting strips in a distance to the peripherally closed supporting strip.

14. The interior fittings according the claim 11, wherein the support arms and the supporting arms are further reinforced by integrally formed ribs.

15. The interior fittings according to claim 1, wherein the support arms protruding downwards in both temple areas comprise means for a fixation on the inside of the helmet shell.

16. The interior fittings according to claim 15, wherein the fixation means are formed so that they can be brought in a positive engagement with the helmet shell.

17. The interior fittings according to claim 1, wherein the support arm protruding backwards in the area of the back of the head comprises a locking device for a fixation on the helmet shell.

18. The interior fittings according to claim 1, wherein a device for mounting a chin strap is formed on the supporting cage.

* * * * *